US006583540B2

(12) United States Patent
Al-Refai

(10) Patent No.: US 6,583,540 B2
(45) Date of Patent: Jun. 24, 2003

(54) INCANDESCENT MULTI-FILAMENT LIGHT BULB

(76) Inventor: Hashem Al-Refai, P.O. Box 17540, Alkhaldia 72456 (KW)

( * ) Notice: Subject to any disclaimer, the term of this patent is extended or adjusted under 35 U.S.C. 154(b) by 118 days.

(21) Appl. No.: 09/782,044

(22) Filed: Feb. 14, 2001

(65) Prior Publication Data

US 2002/0109448 A1 Aug. 15, 2002

(51) Int. Cl.[7] ..... H01K 1/00

(52) U.S. Cl. ..... 313/316; 313/318.03; 313/318.04; 313/272

(58) Field of Search ..... 313/272, 318.03, 313/318.04, 316, 25; 315/64; 362/211, 212; 439/615, 616

(56) References Cited

U.S. PATENT DOCUMENTS 1,120,492 A * 12/1914 Hino ..... 315/69
1,641,068 A * 8/1927 Czech ..... 313/316
3,886,400 A * 5/1975 Dill ..... 315/64
3,946,263 A * 3/1976 Protzeller ..... 313/312

* cited by examiner

*Primary Examiner*—Ashok Patel
*Assistant Examiner*—Jason Phinney
(74) *Attorney, Agent, or Firm*—Dennison, Schultz & Dougherty

(57) ABSTRACT

A multi-filament light bulb which is lightable one filament at a time includes a sealed glass envelope, a base fixed to the envelope and a plurality of filaments supported within the glass envelope. The bulb also includes a ring-shaped insulator having one or more electrical contacts electrically isolated from one another disposed thereon. The ring-shaped insulator is disposed in the base of the bulb with each of the electrical contacts connected to one of the filaments. A plurality of radially depressable metal tab switches are disposed in the base of the bulb adjacent to the contacts on the ring insulator for completing an electrical circuit to thereby illuminate one of the filaments.

3 Claims, 5 Drawing Sheets

INCANDESCENT MULTI-FILAMENT LIGHT BULB

FIELD OF THE INVENTION

This invention relates to an incandescent multi-filament light bulb and more particularly to a multi-filament electric light bulb which is lightable one filament at a time.

BACKGROUND FOR THE INVENTION

Incandescent light bulbs are commonly used in most households and in many commercial establishments. However, it is well known that such bulbs have a limited life time and after a certain number of hours of operation, the bulbs will fail. In most cases of failure, an essential structural component, the light emitting filament burns out rendering the light bulb inoperative. At times, a burned-out light bulb creates a safety hazard, as for example, when the bulb had been used to illuminate a stairway or other obstacle. At other times, the loss of a light bulb is an inconvenience which may be exacerbated by a failure to stock a reserve bulb.

There have been numerous efforts to overcome the short comings of single filament bulbs. For example, a U.S. Patent of Dill, U.S. Pat. No. 3,886,400 discloses a multi-filament light bulb wherein the filament can be individually energized by movement of a selector mounted on the base of the bulb. As disclosed therein, the selector is moved circumferentially to energize a different filament so that the bulb does not have to be thrown away when a first filament fails.

A rotatable multiple filament lamp and socket adapter is disclosed in the U.S. Pat. No. 4,121,134. As disclosed therein, a multi-filament lamp has one set of ends of all filaments connected to a common conductor and the ends of another set individually connected to separate conductors. The filaments are sequentially lightable by turning the lamp in a socket adapter that is screwed into a standard light socket.

A further approach to a multiple filament incandescent bulb is disclosed in a U.S. Pat. No. 4,179,637 of Santora. The Santora patent discloses a bulb with a plurality of filaments, the first of which is mounted between a first and second current supply member to emit light in response to a flow of electrical energy. The remainder of the filaments on reserve or reserve filaments are mounted between the first and second current supply members with electrical connection being established only between the first current supply member and the reserve filament. Biasing means are provided for urging the second current supply member in the direction of a longitudinal axis defined by the filaments. The biasing force is counteracted by the first filament and in later stages of the life of the bulb by one of the reserve filaments.

Notwithstanding an apparent lack of commercial success of the aforementioned multi-filament bulbs, it is presently believed that there may be a relatively large commercial demand for an improved multi-filament bulb in accordance with the present invention. It is believed that there will be a demand because the multi-filament bulbs in accordance with the present invention have a number of advantages over the prior art bulbs. For example, the multi-filament bulbs disclosed herein will have a longer life than a single filament bulb. The bulbs will also provide a built-in back-up for bulb failure without a need for a special socket or attachment. Further, the multi-filament bulb with one embodiment of the invention may be readily inserted in a bayonet type of bulb.

It is also believed that the multi-filament bulbs in accordance with the present invention can be manufactured and sold at a competitive price with a considerable savings in raw material since one multi-filament bulb will replace three or four single filament bulbs. A further advantage is that the bulbs, in accordance with the present invention, provide advance notice to a consumer or householder when it is time to order or inventory a replacement bulb, as for example, when the householder selects the last filament.

In addition, the multi-filament bulb in accordance with the present invention may be readily changed from one filament to the next by removing the bulb from the socket, making the change and reinserting the bulb in the socket. Further by removing the bulb from the socket, there is no danger of an electric shock. Also, by manually changing from one filament to the next, it is apparent how many filaments are left which alerts a householder to order a replacement when the last or next-to-last filament is selected.

BRIEF SUMMARY OF THE INVENTION

In essence, the present invention contemplates an incandescent multi-filament electric light bulb which is lightable one filament at a time. The multi-filament electric light bulb includes a sealed glass envelope and a base fixed to the glass envelope in the same manner as a conventional electric light bulb. The incandescent light bulb, in accordance with the present invention, includes a plurality of incandescent filaments and means including a glass stem or support for supporting the filaments within the glass envelope. A fist and second electrical contact which are electrically isolated from one another are disposed in the base of the bulb. These two contacts may also be provided in a conventional manner with one of the contacts in the center of the bottom of the base and the other as a metal ring extending around the base for contact with a metal ring in a socket. The multi-filament bulb also includes a common connector for connecting each of the filaments to one of the electrical contacts and in a preferred embodiment of the invention to the electrical contact which is in the center bottom portion of the base. Switch means are also disposed in the base for completing an electrical circuit which includes the first and second contacts, the common connector and one of the filaments to energize the filament and illuminate the bulb, when the bulb is inserted in a suitable socket and connected to a source of electrical energy. A key element of the present invention resides in the switch means which includes a ring-shaped insulater, preferably glass, which is positioned within the base and which has a plurality of electrical contacts thereon. The contacts on the ring-shaped insulator are electrically isolated from one another and each of the contacts on the ring-shaped insulator are electrically connected to one of the filaments. The multi-filament light bulb also includes a plurality of inwardly depressable switches or metal tabs with each inwardly depressable switch adjacent to one of the contacts on the ring-shaped insulator. Thus, when a filament burns out, the bulb can be removed from the socket and one of the switches depressed radially to connect another of the filaments to the first and second contact to complete the circuit. Then when the bulb is re-inserted in a socket and connected to a source of electricity, it is illuminated.

The invention will now be described in connection with the accompanying drawings wherein like reference numerals have been used to indicate light parts.

DESCRIPTION OF THE PREFERRED EMBODIMENT OF THE INVENTION

As illustrated in FIGS. 1–5, an incandescent multi-filament electric light bulb 10 includes an hermatically, sealed transparent or translucent glass envelope 12. This glass envelope 12 is generally similar to if not identical in construction, size and shape as those used in conventional, single or multi-filament light bulbs of similar wattage. However, a multi-filament light bulb as disclosed herein is lightable one filament as a time. The bulb 10 also includes a base 14 which is fixedly attached to the glass envelope in a conventional manner as will be well understood by persons of ordinary skill in the art of manufacturing electric light bulbs.

Figure 1:
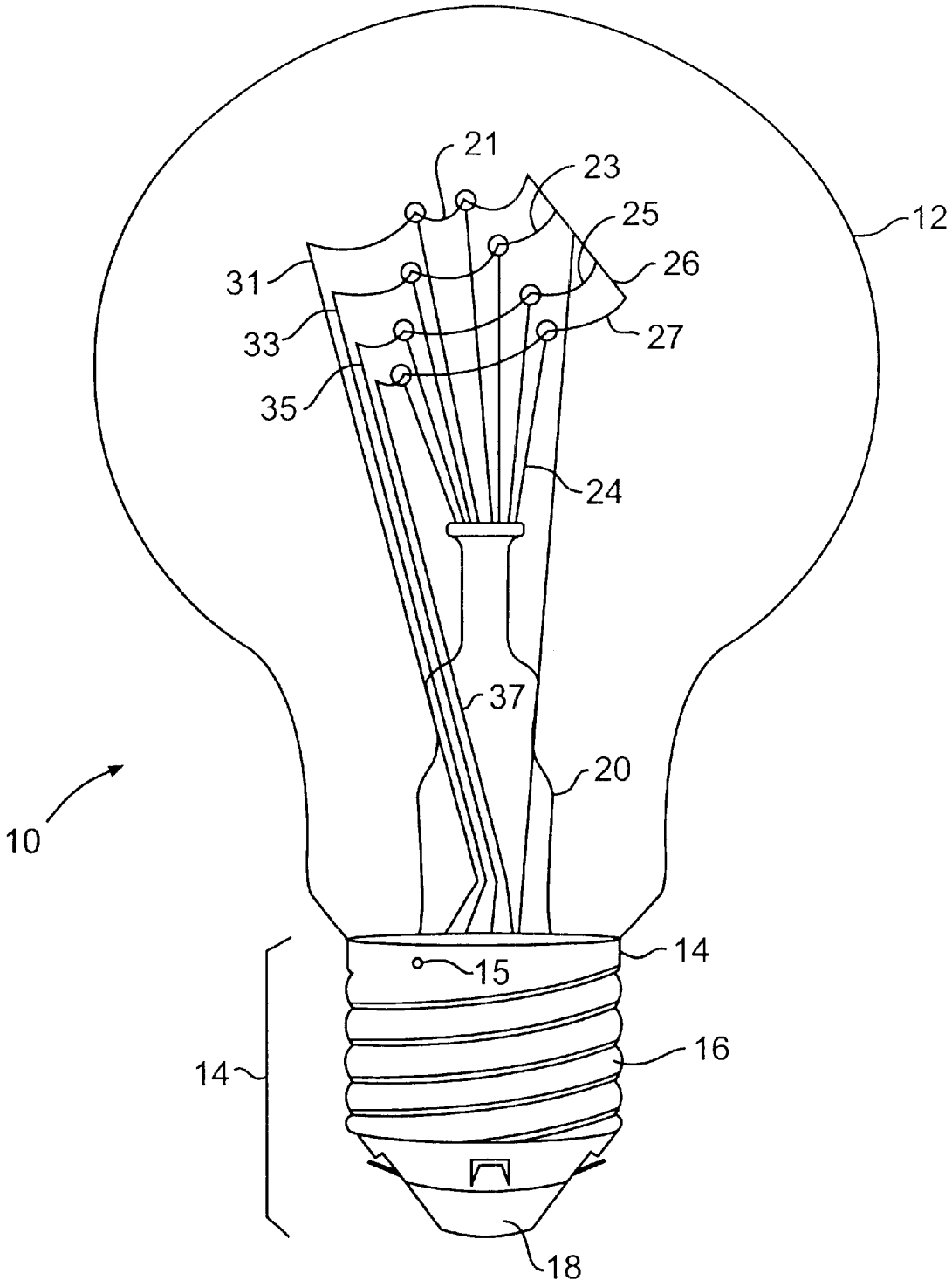
FIG. 1 is a side elevational view of a multi-filament light bulb in accordance with one embodiment of the invention.
Figure 2:
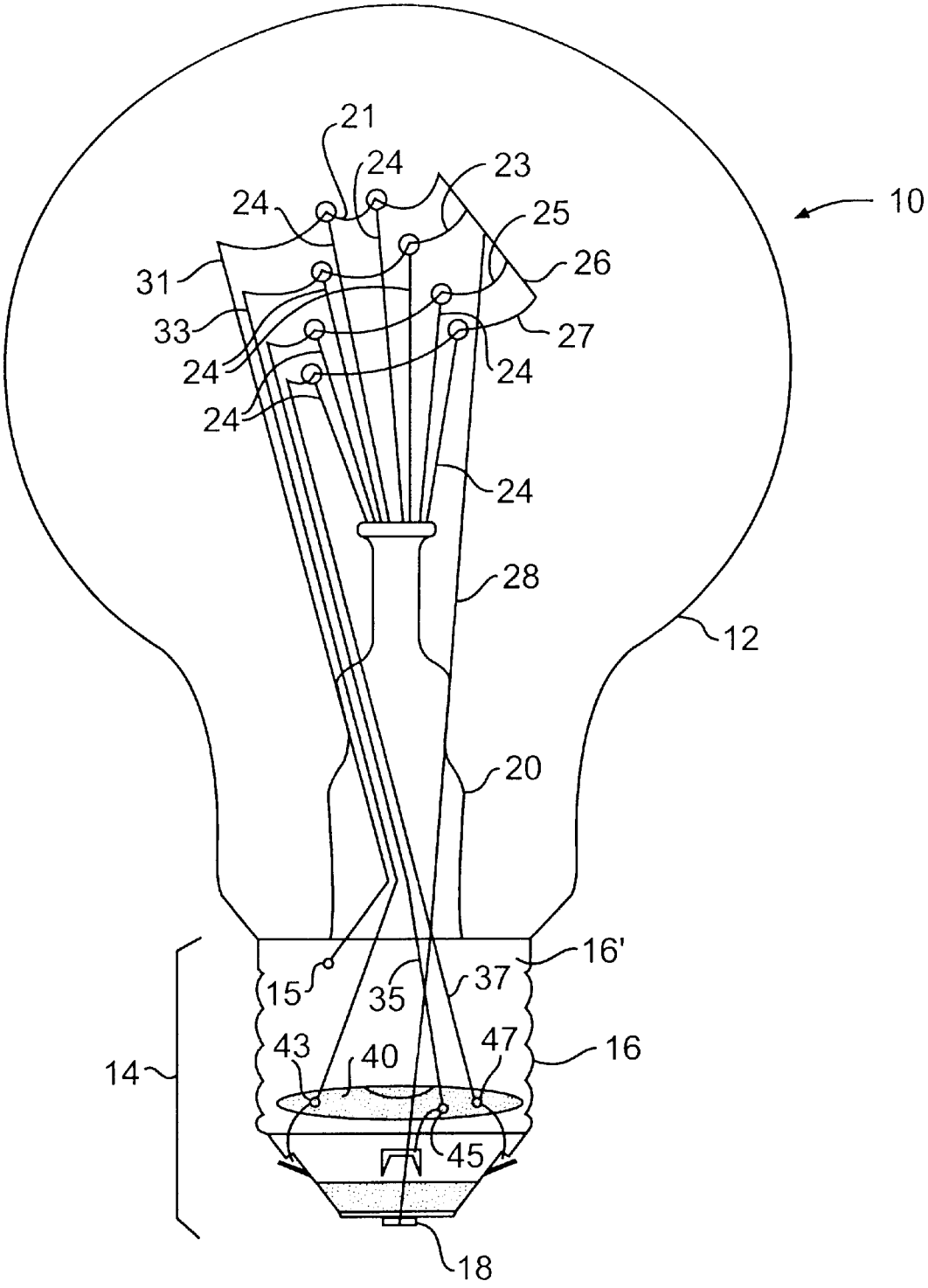
FIG. 2 is a diagrammatic view of the multi-filament light bulb shown in FIG. 1.
Figure 3:
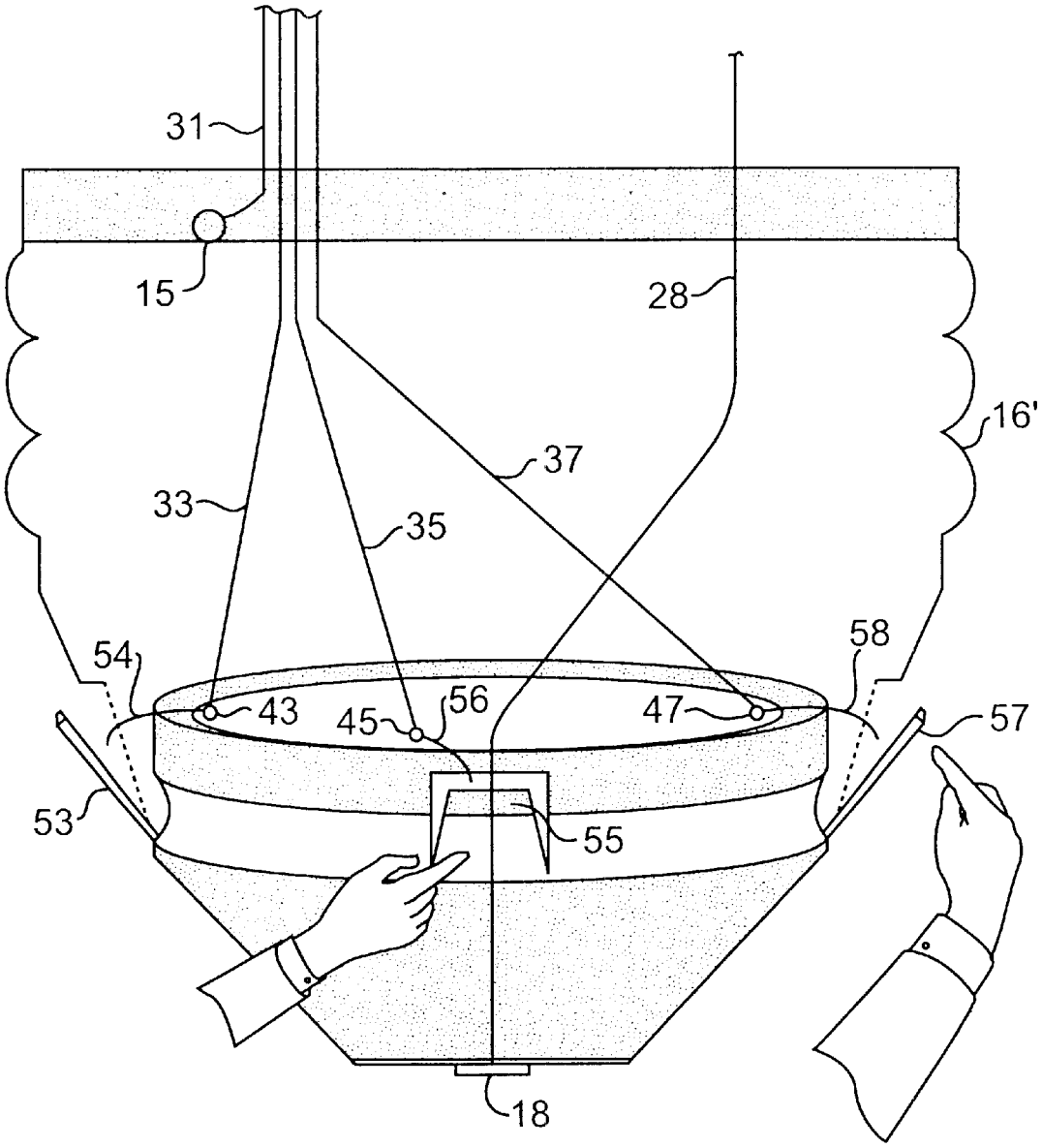
FIG. 3 is a diagrammatic view which illustrates a second embodiment of the invention.
Figure 4:
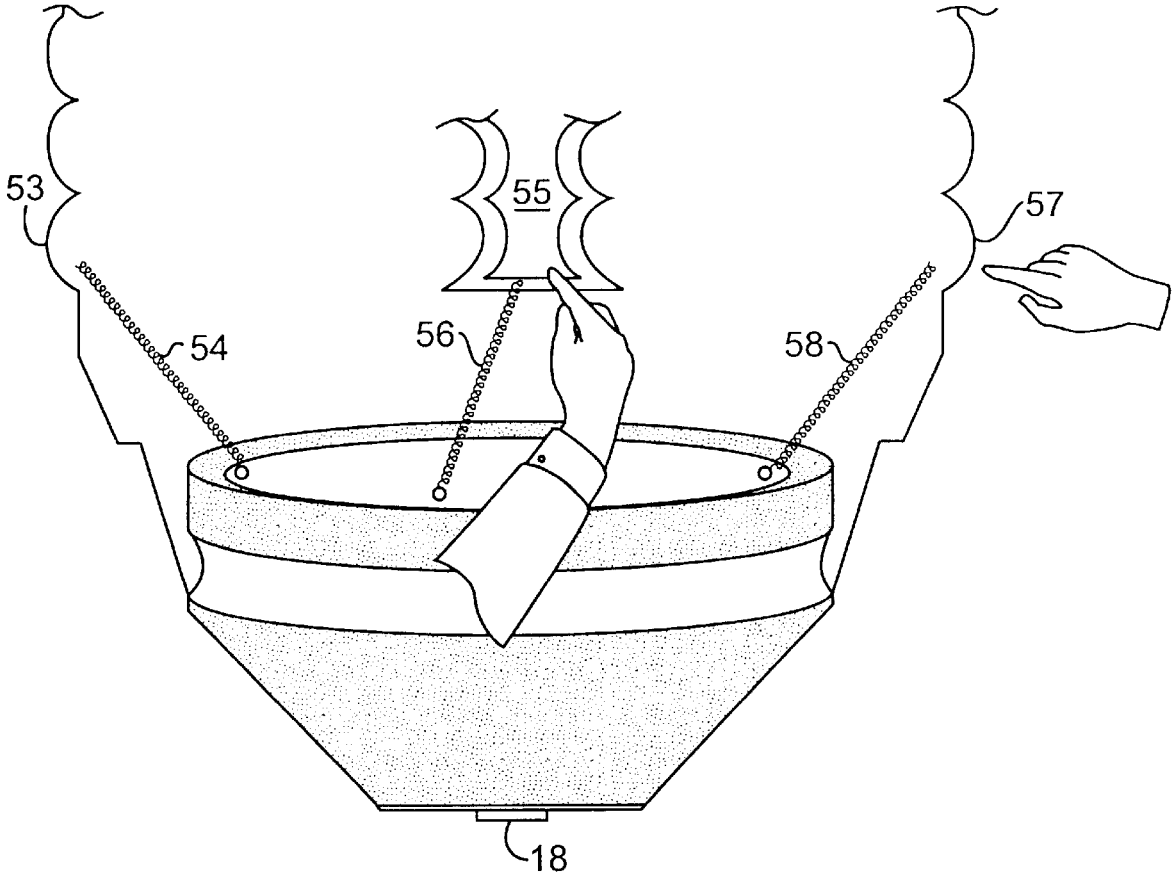
FIG. 4 is a diagrammatic view which illustrates a further embodiment of the invention.
Figure 5:
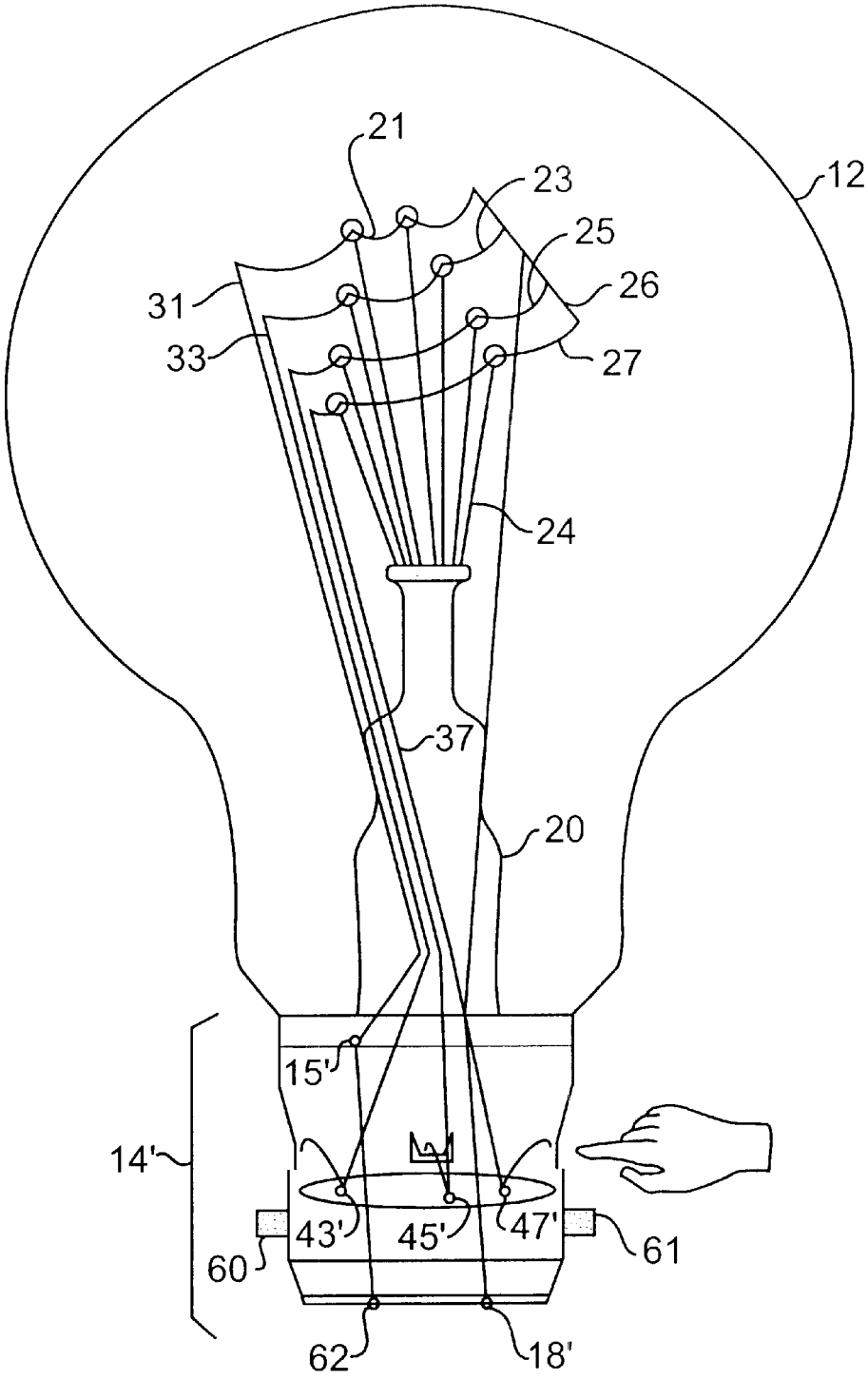
FIG. 5 is a diagrammatic view which illustrates another embodiment of the invention.

The base 14 may include a threaded portion 16 as in a conventional light bulb of the screw type as shown in FIGS. 1–4, or may be in the form of a bayonet type as shown in FIG. 5. In either case, the bulb is inserted into a conventional socket (not shown). As illustrated in FIGS. 1–4, the base 14 includes a button contact 18 and a separate contact 15 through the threaded portion 16. This second contact is through a metal feral 16' which is in contact with a side of a socket in a conventional manner.

In a preferred embodiment of the invention, the bulb 10 includes first, second, third and fourth filaments 21, 23, 25 and 27, respectively. These filaments are elongated and may be made of tungsten, doped tungsten or other suitable material. The shape of the filaments 21, 23, 25 and 27 may be single, double or triple coiled or other suitable configuration that incandesces at designed conditions.

The bulb 10 also includes a centered glass stem or support 20 that is disposed in a lower portion of the glass envelope 12 and which extends upwardly into the bulb 10. This centered support 20 supports the filaments 21, 23, 25 and 27 by means of a plurality of filament supports 24. The plurality of supports 24 are fixed to the centered support 20 and extends upwardly into the bulb in a conventional manner. The plurality of supports 24 are made of any suitable non-conducting material.

One end of each of the filaments 21, 23, 25 and 27 are connected to a common conductor 26 which is then connected to a power conductor 28. This power conductor 28 is operatively connected to the common conductor 26 and the bottom contact 18. The other ends of the filaments 21, 23, 25 and 27 are connected to means or conductors 31, 33, 35 and 37, respectively.

The first conductor 31 connects the filament 21 to the contact 15 which is connected to the metallic feral which extends around the threaded portion 16 of the base 14. Therefore, when the bulb 10 is screwed into a lamp socket and the lamp is turned on, electricity flows through the button contact 18, conductor 28, common conductor 26, filament 21 and conductor 31 and contact 15 to complete the circuit and cause the filament 21 to incandesce.

An important feature of the multi-filament light bulb in accordance with the present invention resides in a ring-shaped or circular insulator 40 which is disposed in the base 14. The ring-shaped insulator 40 includes three electrical contacts 43, 45 and 47 which are electrically connected to the conductors 23, 25 and 27, respectively.

The conductors extend outwardly from the bottom of the hermatically sealed glass envelope 12 in a conventional manner. The base 14 also includes a plurality of switches in the form of displacable metal tabs 53, 55 and 57 as illustrated more clearly in FIG. 3.

As shown in FIG. 3, one of the metal displacable tabs 53, 55 and 57 is bent inwardly to engage a spring metal element 54, 56 or 58 by an individual's finger as shown. These displacable metal tabs 53, 55 and 57 are adjacent to the spring elements 54, 56 and 58, respectively, which are, in turn, adjacent to the contacts 43, 45 and 47. As illustrated, the spring elements extend over the ring-shaped insulator 40.

In a further embodiment of the invention, as illustrated in FIG. 4, the spring elements 54, 56 and 58 extend upwardly within the interior of the base 14, and are contacted by displacable or deformable metal tabs 53, 55 and 57. In practice, these tabs are formed in the metal feral 16' by cutting on three sides. Appropriately sized openings behind the tabs are provided in the base portion 16.

FIG. 5 illustrates a further embodiment of the invention wherein a multi-filament incandescent light bulb includes a bayonet base and a plurality of hook-shaped spring elements. As illustrated therein, the base 14' includes a pair of pins 60–61 which are adapted to engage a conventional socket for a bayonet-type bulb. In this embodiment of the invention, the first contact 18' is in the lower part of the base 14' but off-center. A second contact 62 is also disposed in the bottom of the base 14' that is in electrical contact with contacts 15'.

While the invention has been described in connection with its preferred embodiments, it should be recognized that changes and modifications may be made therein without departing from the scope of the appended claims.

What is claimed is:

1. An incandescent multi-filament electric light bulb which is lightable one filament at a time, said incandescent multi-filament electric light bulb comprising a hermitically sealed glass envelope and a circular base fixedly attached to said glass envelope, four incandescent filaments and means including a glass stem for supporting said filaments within said envelope, a first and a second electrical contact electrically isolated from one another and disposed in said base with one of said contacts in the center bottom of said base and the other on a side of said base, a common conductor for connecting each of said filaments to said first electrical contact in the center of the bottom of said base and switch means disposed in said base for completing an electrical circuit including said first and second contacts, said common conductor and one of said filaments to thereby energize one of said filaments for illuminating the bulb when said bulb is inserted into a socket and connected to a source of electricity, and said switch means including a circular ring-shaped, glass insulator positioned within said base and having three contacts electrically isolated from one another thereon and with each of said contacts connected to different ones of said filaments, and three spring elements each of which is connected to one of said contacts and which is extends over said glass insulator, and three inwardly depressible metal tab switches each of which is adjacent to one of said spring elements and movable in a radial direction which each of said switches adapted to contact one of said spring elements for completing an electrical circuit including one of said filaments when another of said filaments has burned out and wherein one of said four filaments is directly connected to said metal base and independently of said glass insulator.

2. An incandescent multi-filament electric light bulb which is lightable one filament at a time according to claim 1 in which said base is a screw-type base.

3. An incandescent multi-filament electric light bulb which is lightable one filament at a time according to claim 1 in which said base is a bayonet type base.

* * * * *